US005595025A

United States Patent [19]

MacPhail-Fausey

[11] Patent Number: 5,595,025

[45] Date of Patent: Jan. 21, 1997

[54] WINDOW REGULATOR ASSEMBLY

[75] Inventor: Bryan D. MacPhail-Fausey, Pontiac, Mich.

[73] Assignee: Excel Industries, Inc., Elkhart, Ind.

[21] Appl. No.: 432,954

[22] Filed: May 1, 1995

[51] Int. Cl.[6] ..... E05F 11/44

[52] U.S. Cl. ..... 49/351

[58] Field of Search ..... 49/398, 399, 350, 49/351, 227

[56] References Cited

U.S. PATENT DOCUMENTS

| | | | |
|---|---|---|---|
| 2,008,517 | 7/1935 | Roethel | 49/351 X |
| 3,816,962 | 6/1974 | Ladd et al. | 49/351 X |
| 4,118,893 | 10/1978 | Becker | 49/350 X |
| 4,924,627 | 5/1990 | Lam et al. . | |
| 4,986,029 | 1/1991 | Richter . | |
| 5,461,826 | 10/1995 | Heckel et al. . | |

FOREIGN PATENT DOCUMENTS

| | | | |
|---|---|---|---|
| 1225535 | 7/1960 | France | 45/351 |
| 2431595 | 3/1980 | France | 49/349 |

*Primary Examiner*—Kenneth J. Dorner
*Assistant Examiner*—Jerry Redman
*Attorney, Agent, or Firm*—Banner & Witcoff, Ltd.

[57] ABSTRACT

A regulator assembly for moving a window panel between its open and closed positions, suitable in certain preferred embodiments for operation of motor vehicle windows for example, has drive mechanism such as a hand crank or electric motor for delivering a drive force to the regulator assembly to move the window panel. Linkage, including at least a lifting arm and, optionally, a cross-arm, etc., is connected to the window panel at one end and mounts at its other end a sector gear engaging the drive mechanism. Load absorbers are provided for releasably absorbing drive force upon operation of the regulator assembly between any two points of travel of the window panel between the open and closed positions. The load absorbers help to level the peak loads otherwise experienced by the regulator assembly and, particularly, an electric drive motor thereof, during start-up and travel stall at the full open position, full closed position, intrusion or blockage during closure travel.

10 Claims, 4 Drawing Sheets

WINDOW REGULATOR ASSEMBLY

INTRODUCTION

The present invention is directed to a window regulator assembly for a glazing panel which is movable between open and closed positions. More particularly, the invention is directed to a window regulator assembly having means to reduce peak forces experienced by components of the assembly during normal operation.

BACKGROUND

Window regulators for operating a moveable glazing panel between open and closed positions typically have a motor or other drive means for delivering drive force to a gear and linkage assembly. Generally, a quadrant or sector gear is mounted at one end of a lifting arm by welding, riveting or other fixed mounting means. The other end of the lifting arm is connected near the perimeter of the glazing panel. Frequently a cross-arm pivotally connected to the lifting arm at or near respective mid-points is also connected to the glazing panel at one end and is supported in a travel channel at the other end. The components of the window regulator assembly must be sufficiently durable to withstand and transmit the drive forces necessary for opening and closing the window. Drive forces experienced at certain points of travel of the glazing panel are substantially higher than those experienced at other points of travel. Most notably, forces experienced by the window assembly components tend to peak when a drive motor is first actuated, that is, when the motor "torques-up." This occurs when the glazing panel is moved from its full up or full down position, and also when it is moved from any stationary position in between. Similarly, peak forces are experienced by the window regulator assembly components when the glazing panel stalls during travel, such as upon reaching its full up or full down position, or when being stopped due to an intrusion or other blockage of the glazing panel as it travels.

In known window regulator assemblies, all components must be designed and fabricated with sufficient rigidity and durability to withstand not only normal force levels encountered during simple up and down travel of the glazing panel, but also the aforesaid peak forces or loads encountered at initial start-up and travel stall. This adds considerably to the cost of window regulator assembly components. It would be desirable to reduce the peak forces encountered by certain window regulator assembly components, especially drive motors, to enable the use of less cosily, lighter service load components. In one known approach, so-called smart two-speed motors are employed which torque-up in stages, thereby reducing peak loads transmitted through the window regulator components. Unfortunately, multi-speed motors add to the cost and complexity of window regulator assemblies. Other known designs have contemplated the use of plastic stops to engage the sector gear or lifting arm, etc., at the full up or full down position. This approach fails to provide adequate drive force management and, in particular, fails to address the problem of start-up and travel stall other than at the full up and full down position.

An example of a window regulator employing a down-stop is shown in

U.S. Pat. No. 4,986,029 to Richter. A plastic spacer is provided in a window sash track between the rollers of a cross-arm regulator assembly shown in U.S. Pat. No. 4,924,627 to Lam et al. Compression, if any, of such plastic spacer would occur only at the full down position or full up position of the glazing panel.

It is an object of the present invention to provide window regulator assemblies in which drive force transmission through the assembly components is managed so as to reduce the peak forces experienced by at least some of the assembly components at start-up and travel stall at all points of travel of the glazing panel. Additional objects of the invention will be understood by those skilled in the art, that is, by those knowledgeable and experienced in this area of technology, in view of the following disclosure and detailed description of certain preferred embodiments.

SUMMARY

In accordance with a first aspect, a regulator assembly is provided for a window panel which is movable between open and closed positions. The regulator assembly has drive means such as a hand crank or, more preferably, a reversible output electric motor, for delivering drive force to reversibly operate the regulator assembly to move the window panel between the open and closed positions. As is typical of such regulator assemblies employed in motor vehicle applications and the like, the window can be selectively moved between any two intermediate points within its full range of travel. A sector gear or the like operatively engages the drive means, for example, gear teeth carried by an output shaft of an electric motor as described above. Linkage is provided, including a lifting arm operatively interconnecting the sector gear to the window panel for transmitting drive force. Means also are provided for releasably absorbing drive force upon operation of the regulator assembly between any two points of travel of the window panel between the open and closed positions. Such force or load absorber means preferably comprises an elastomeric member or body. In preferred embodiments in which the sector gear is pivotally mounted relative the lifting arm, the elastomeric member can be positioned between a rigid surface of the sector gear and a rigid surface of the lifting arm, such that the angle at which the lifting arm extends from the sector gear is at least temporarily variable by compression of the elastomeric member in response to drive force (or at least in response to peak drive forces) during operation of the regulator assembly.

Without wishing to be bound by theory, the load absorber element of the present invention is understood to aid in leveling peak loads otherwise experienced by the drive motor and/or other components of the regulator assembly. Peak loads typically are experienced, for example, during start-up and stall of window panel travel. This may occur not only at the full open and full closed positions, but also at start-up from an intermediate position, upon intrusion or blockage of window travel, particularly during window closure, etc. Reducing motor impact and shock loads to the regulator assembly can significantly increase the normal operating life for a regulator assembly of given durability. More generally, by releasably absorbing and thereby reducing peak system forces or loads during normal operation, overall durability, quiet operation and quality performance are improved. These and additional aspects and advantages of the present invention will be further understood from the following detailed description of certain preferred embodiments.

BRIEF DESCRIPTION OF THE DRAWINGS

Certain preferred embodiments of the present invention are discussed below in connection with the appended drawings, in which similar numerals are employed to designate corresponding parts throughout the several views.

DETAILED DESCRIPTION OF CERTAIN PREFERRED EMBODIMENTS

Consistent with the general disclosure provided above, the preferred embodiments now described in detail employ load absorbing means in the nature of shock absorbers, such as spring members or, more preferably, elastomeric members to releasably absorb peak drive forces experienced by regulator assembly components, including the start-up shock and the impact of glazing panel travel stall. By reducing the force impact experienced by the drive motor in particular, the shock absorbers can improve the performance and service life of the electric drive motor and other regulator assembly components. More particularly, in the embodiments described below, an elastomeric member is positioned between a rigid member or surface of a sector gear and a rigid member or surface of the firing arm. In these preferred embodiments, the sector gear is not mounted with a fixed orientation to the lifting arm, as by welding, riveting or the like. Rather, they are pivotally mounted together. Rotation of the sector gear relative the axial line of the lifting arm is restrained by the load absorbing means. That is, drive force transmitted through the regulator assembly is releasably absorbed, at least at peak loads, by restrained pivoting of the sector gear relative the lifting arm. The elastomeric member or other shock absorber preferably is sandwiched between such two rigid members, for example being positioned between an upturned flange of the lifting arm and an upturned flange of the sector gear, or being mounted to either of these two components on a rivet to engage an upturned flange of the other. The elastomeric member is then directly compressed upon pivoting motion of the sector gear relative the lifting arm in parallel planes. The shock absorber could, alternatively, be adhered or otherwise fixed to a surface of the sector gear or lifting arm, which is substantially perpendicular to the interacting surface of the other component. In such embodiments, the shock absorber may be deflected laterally, rather than directly compressed as the sector gear and lifting arm pivot relative one another. The aforesaid rigid members or surfaces of the sector gear and lifting arm may be somewhat flexible or yielding. They should be able to apply sufficient force against the elastomeric member or other shock absorber to substantially compress or deflect it as needed to releasably absorb drive forces, at least peak drive forces, for example to releasably absorb start-up shock or the impact of glazing panel travel stall at the full up or full down positions, or if a blockage or intrusion is encountered by the glazing panel during travel between those two positions.

Figure 1:
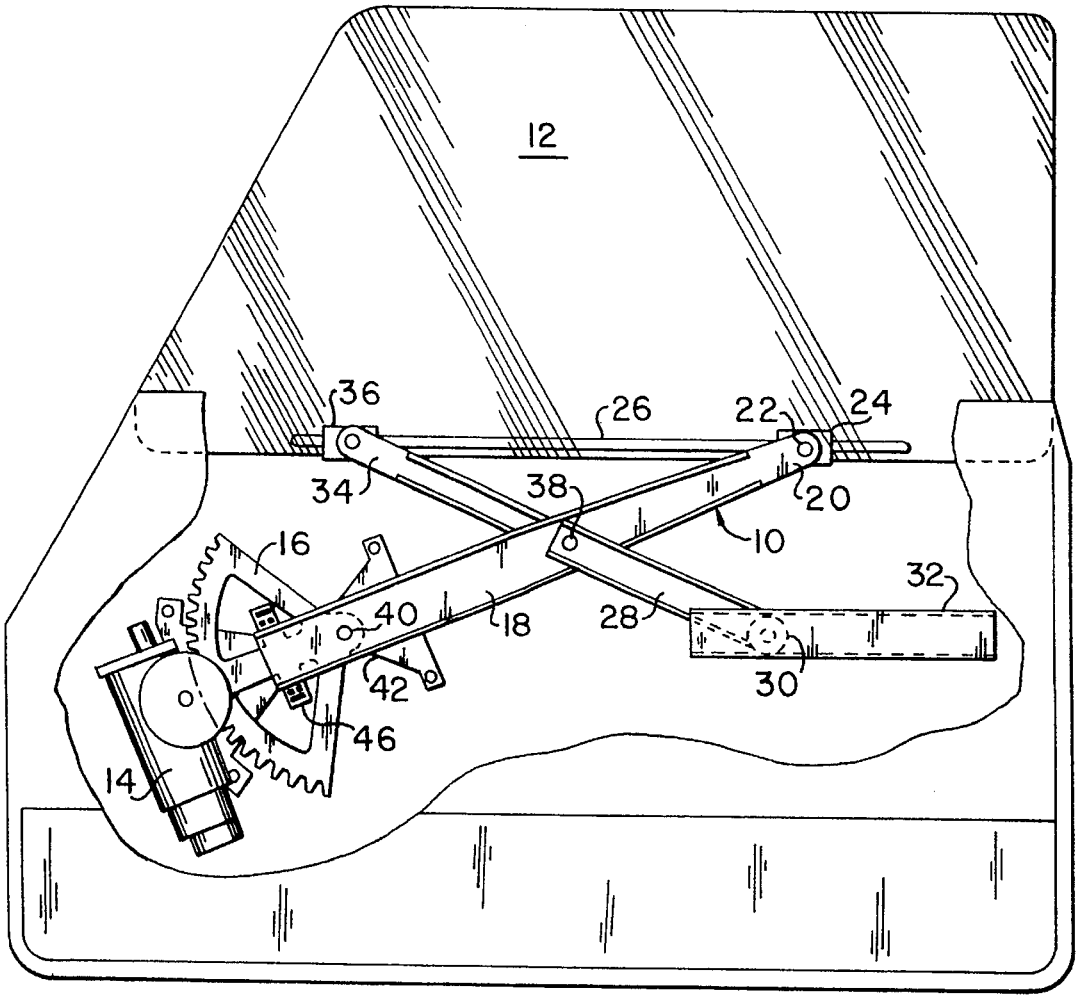
FIG. 1 is a schematic elevation view of a window regulator assembly in accordance with a first preferred embodiment of the invention.
Figure 2:
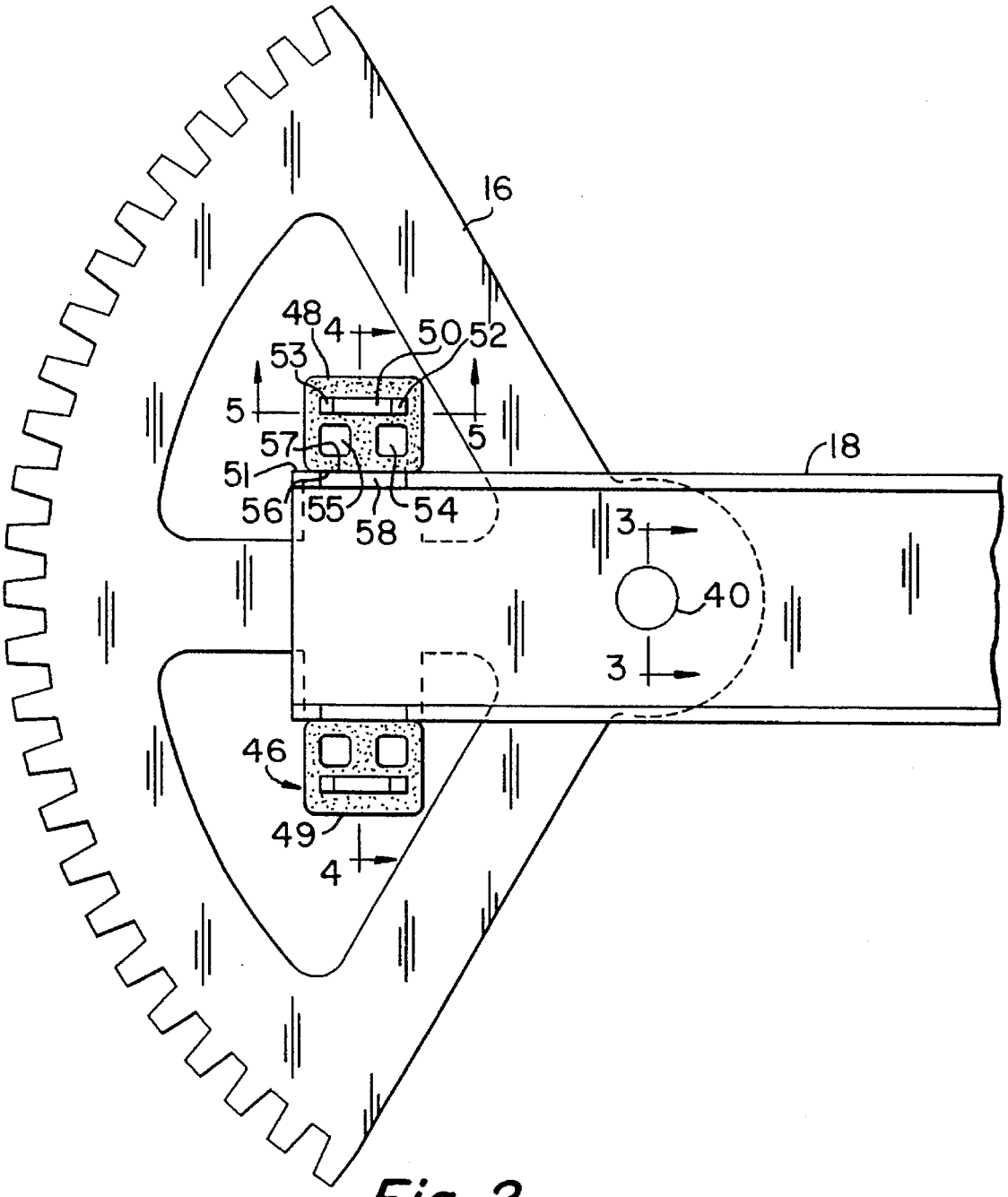
FIG. 2 is an enlarged view of the sector gear and lifting arm, partially broken away, of the window regulator assembly in FIG. 1.
Figure 3:
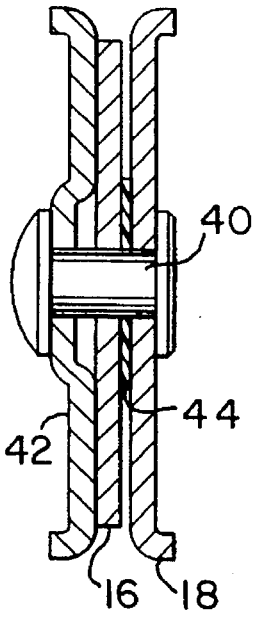
FIG. 3 is an enlarged section view taken through lines 3—3 of FIG. 2.
Figure 4:
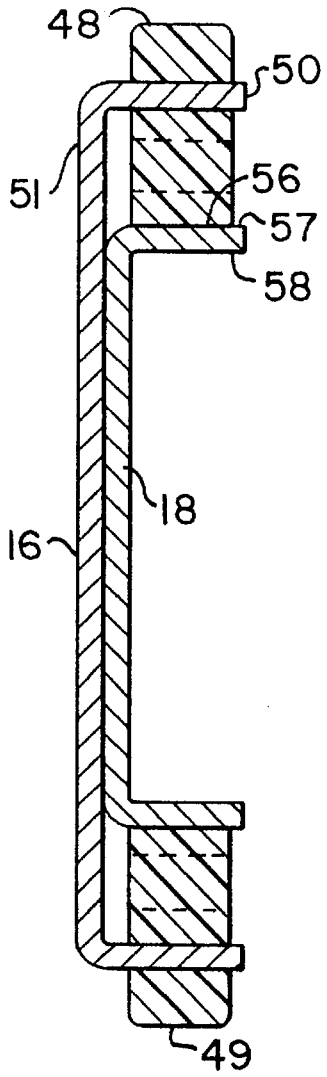
FIG. 4 is an enlarged section view taken through lines 4—4 of FIG. 2.

A cross-arm regulator assembly for a motor vehicle door window in accordance with a preferred embodiment is illustrated in FIG. 1. The regulator assembly 10 is adapted to move glazing panel 12 between its open (down) and closed (up) positions. Drive means of the window assembly includes electric motor 14 which is connected to the electrical system of the motor vehicle, including an actuator switch within the passenger compartment for selectively reversible operation. Electric drive motor 14 has an output gear engaging the gear teeth of sector or quadrant gear 16 in accordance with well known design principles. Sector gear 16 is mounted near the first end of a lifting arm 18. The opposite end 20 of lifting arm 18 is pivotally connected at pivot point 22 to a slider block 24 which travels laterally (i.e., right-to-left and left-to-right as viewed in FIG. 1) on sash track 26 affixed at the lower peripheral edge of glazing panel 12 in accordance with known techniques. A cross-arm 28 is pivotally mounted to the lifting arm 18 at respective mid-points, forming pivotal connection 38. It will be understood that the connection mid-points of the two arms need not be at their precise longitudinal center point, but rather will be determined in accordance with design principles well known to those skilled in the art. A first end of cross-arm 28 is pivotally mounted to slider block 30 adapted to travel laterally in structural support track 32, which typically is rigidly mounted to the structure of the vehicle door. The opposite end 34 of cross-arm 28 is pivotally mounted to slide track 36, mounted for lateral travel on sash track 26 at the bottom perimeter of glazing panel 12.

As best seen in FIGS. 2 through 5, the sector gear 16 is not rigidly or fixedly mounted to lifting arm 18. Rather, these two components are pivotally joined at mounting post 40, which extends substantially rigidly from backplate 42. Backplate 42 is a structural element integral with the frame of the vehicle door, such as to remain substantially immobile relative the sector gear and lifting arm during operation of the regulator assembly. It can be seen that mounting post 40 is circular in cross section and extends through circular apertures in the sector gear and lifting arm in a direction substantially perpendicular to the plane of those two components. Suitable spacers and friction reducing elements, such as spacer 44 seen in FIG. 3, preferably are provided to facilitate rotational movement of the sector gear relative the lifting arm at the pivot post 40. Remote from pivot post 40, closer to the end of lifting arm 18 so as to achieve the advantage of torque leverage, load absorber assembly 46 is provided for releasably absorbing drive force upon operation of the regulator assembly between any two points of travel of the window panel 12 between the open and closed positions. Specifically, in the embodiment of FIGS. 1–5, the load absorber assembly includes a symmetrical arrangement of shock absorbers comprising elastomeric members 48 and 49. Since the configuration and operation of these two elastomeric members is substantially identical, detailed description is provided here only with reference to elastomeric member 48.

Figure 5:
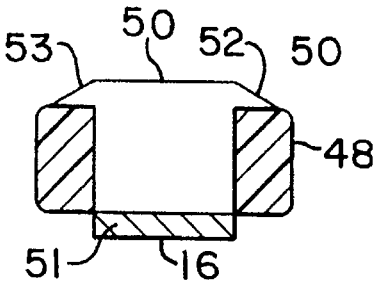
FIG. 5 is an enlarged section view taken through lines 5—5 of FIG. 2.

Elastomeric member 48 is mounted on sector gear 16. More specifically, elastomeric member is 48 is carded on upturned mounting post 50 of extension 51 of sector gear 16. The elastomeric member can be pushed onto upturned mounting post 50, and is captured there by lateral wings 52 and 53 as best seen in FIG. 5. In addition to the mounting aperture in elastomeric member 48 which receives mounting post 50, additional apertures can be provided for controlling the compression and resiliency performance of the elastomeric member. In the embodiment of FIGS. 1 through 5, elastomeric member 48 is seen to have apertures or voids 54 and 55. In general, it will be within the ability of those skilled in the art, in view of and aided by the present disclosure, to select elastomeric materials of suitable resiliency, durability and durometer, and to employ modifying features such as apertures, stiffening elements and the like, to achieve performance characteristics suitable for a particular application of the invention. Numerous suitable elastomeric materials are commercially available and include, for example, natural rubber, Santoprone (™), available from Monsanto Company and Hytrel (™) available from Dupont DeNemours Co., and the like. Preferably, the hardness or durometer of the material is Shore durometer 35A–55D. Numerous alternative suitable materials will be readily apparent in view of the present disclosure.

Upon actuation of the window regulator assembly 10, drive force will be transmitted from the electric motor 14 to sector gear 16. The resistive force of inertia encountered upon such start-up, will be partially and reversibly absorbed by elastomeric member 48 or 49, depending on the direction in which glazing panel 12 is moved. If the window is moved upwardly from the full open or any intermediate travel position, elastomeric member 48 will releasably absorb drive force by compression. More specifically, the sector gear will pivot at mounting post 40 relative the lifting arm, such that their relative rotational orientation will temporarily change. Free surface 56 of elastomeric member 48 engages the facing surface 57 of the upturned flange 58 of the lifting arm 18. Reduction in the distance between upturned flange 58 of the lifting arm and upturned mounting post 50 of the sector gear 16 results in resilient compression of elastomeric member 48. Advantageously, the force absorbed in this operation is automatically and proportionately released as the window travel approaches normal or steady-state conditions. Similarly, there is a corresponding releasable absorption of drive forces when window travel is stalled with continued actuation of the drive motor, for example, when the window panel reaches its full up or full down position, or encounters an intrusion or other blockage of travel at any point between these two positions.

Figure 6:
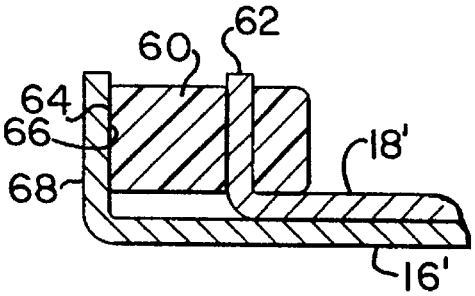
FIG. 6 is a section view corresponding to FIG. 4, of an alternative preferred embodiment of the invention.

The elastomeric member can be carded by the lifting arm, rather than the sector gear. Thus, for example, an alternative preferred embodiment is illustrated in FIG. 6, corresponding to the left side of the view seen in FIG. 4. In the alternative preferred embodiment of FIG. 6, elastomeric member 60 is mounted in a manner corresponding to that illustrated in FIG. 5 on upturned mounting post 62 of lifting arm 18 prime. Exposed face 64 is oriented for face-to-face planar contact with surface 66 of rigid upturned flange 68 of sector gear 16 prime. Thus, rotation of the sector gear relative the lifting arm in one rotational direction or the other, will cause compression of elastomeric member 60 by reduction of the distance between mounting post 62 of the lifting arm and surface 66 of the sector gear.

Figure 7:
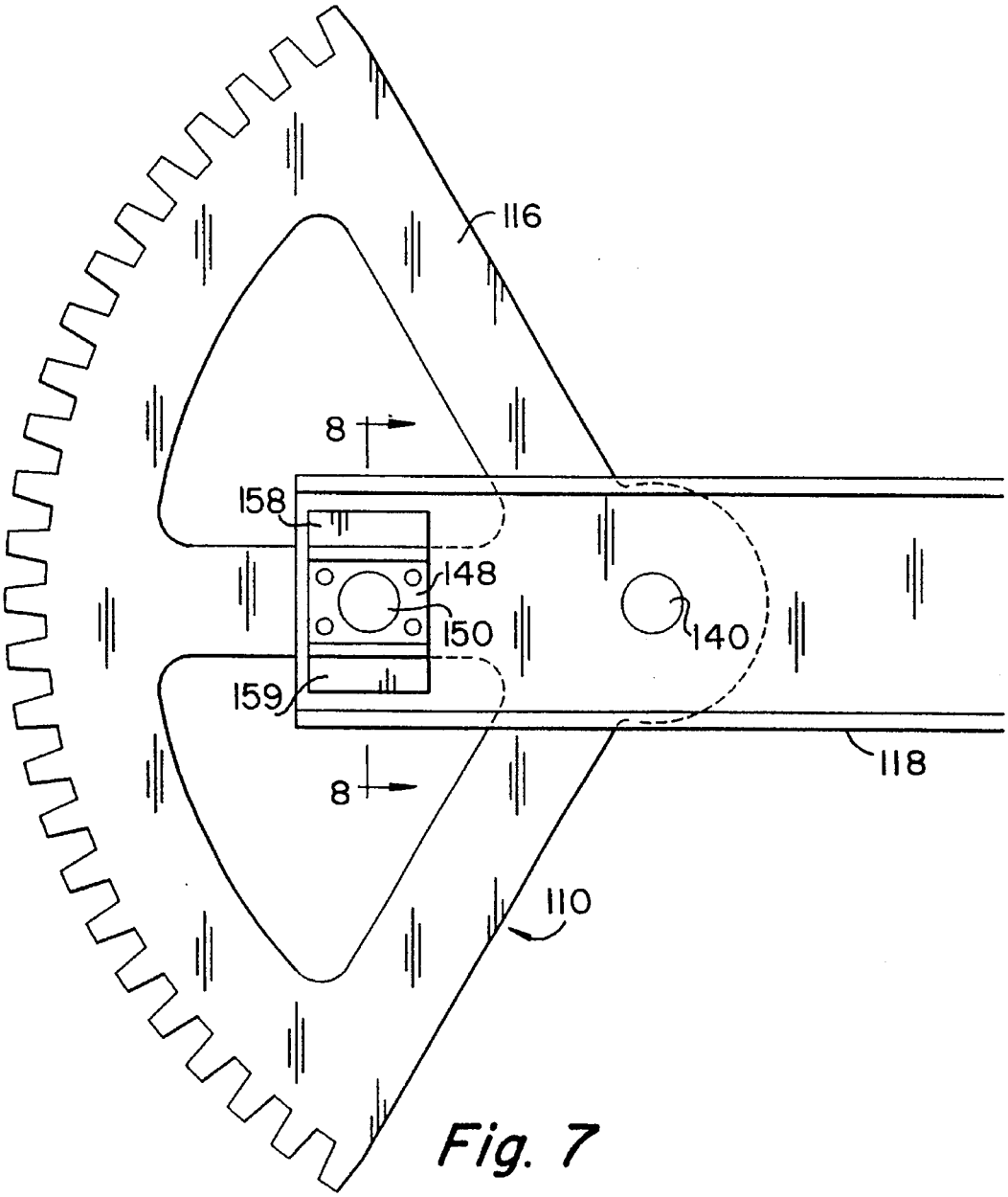
FIG. 7 is a schematic view corresponding to FIG. 2, of an alternative preferred embodiment of the invention.
Figure 8:
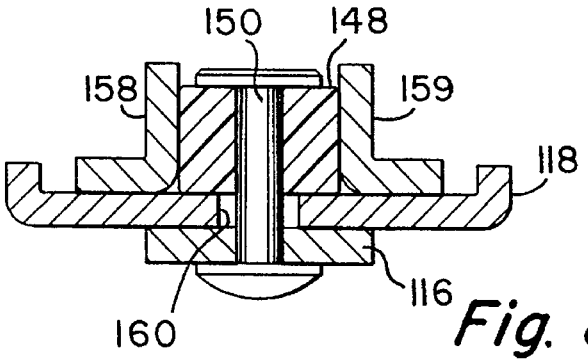
FIG. 8 is an enlarged section view taken through lines 8—8 of FIG. 7.

An alternative preferred embodiment is illustrated in FIGS. 7 and 8, wherein sector gear 116 is seen to be pivotally mounted to lifting arm 118 at pivot point 140, substantially as described above. An elastomeric body 148 in the form of a circular bushing is mounted coaxially on mounting post 150, extending rigidly upward from the plane of the sector gear. Substantially symmetrical fight and left side engagement members 158 and 159 extend substantially rigidly from lifting arm 118 to compressively engage elastomeric member 148. It will be recognized from the description provided above that drive forces (at least peak drive forces) during operation of the window regulator assembly 110 will be at least partially isolated from the drive motor by compression of the elastomeric bushing 148 by engagement member 158 or 159 (depending on the direction of the force). The aperture 160 through the lifting arm 118 is seen to provide sufficient clearance to enable the distance between the engagement members and the mounting post to be decreased by compression of the elastomeric member 148 without making hard contact between the mounting post 150 and the lifting arm 118. Thus, a soft start and a soft stop is provided, with resultant reduction in the wear and tear experienced during operation of the window regulator assembly by components including, most notably, the drive motor of the assembly.

It will be recognized from the above that various modifications, additions and the like, can be made to the preferred embodiments disclosed without departing from the true scope and spirit of the present invention. Accordingly, the following claims are intended to cover such true scope and spirit of the invention.

We claim:

1. A regulator assembly having a window panel movable between open and closed positions, comprising:

drive means for delivering drive force for reversibly operating the regulator assembly to move window panel between the open and closed positions;

gear means comprising a sector gear operatively engaging the drive means, and pivotally mounted to the lifting arm at a pivot point;

linkage means comprising a lifting arm operatively interconnecting the sector gear to the window panel, for transmitting drive force from the drive means to the window panel; and load absorber means mounted to one of said gear means and said linkage means, for releasably absorbing drive force upon operation of the regulator assembly between any two points of travel of the window panel between the open and dosed positions, comprising an elastomeric bushing surrounding a bushing post remote from the pivot point, a rigid bearing surface of one of the sector gear and the lifting arm engaging the elastomeric bushing to limit pivotal movement of the sector gear and lifting arm relative one another.

2. The regulator assembly of claim 1 wherein the elastomeric bushing is mounted to the sector gear and engages a rigid surface of the lifting arm.

3. The regulator assembly of claim 1 wherein the elastomeric bushing is mounted to the lifting arm and engages a rigid surface of the sector gear.

4. The regulator assembly of claim 1 wherein the elastomeric bushing has a Shore durometer of 35A–55D.

5. The regulator assembly of claim 1 wherein the lifting arm is pivotally connected to the window panel and extends from the sector gear at an angle which is at least temporarily variable by compression of the elastomeric bushing in response to said drive force during operation of the regulator assembly.

6. The regulator assembly of claim 1 wherein the sector gear and the lifting arm are both mounted on a pivot pin at said pivot point, the pivot pin mounted to a structural backplate which remains substantially immobile relative the sector gear and lifting arm during operation of the regulator assembly, the load absorber means further comprising an elastomeric bumper between the backplate and one of the gear means and the linkage means, the elastomeric bumper being positioned to absorb drive force at least at the open or closed position of the window panel.

7. The regulator assembly of claim 1 wherein the linkage means further comprises an elongate cross-arm having a first end connected to the window panel and a second end slidably mounted to a support member, and being pivotally connected to the lifting arm at an intermediate pivot point.

8. The cross-arm regulator assembly for a motor vehicle window panel in accordance with claim 1, wherein the sector gear and the lifting arm are both mounted on a common pivot pin at the pivot point, the pivot pin being mounted to a structural backplate which remains substantially immobile during operation of the regulator assembly, and the elastomeric bushing is mounted between a rigid surface of the sector gear and a rigid surface of the lifting arm.

9. The cross-arm regulator assembly for a motor vehicle window panel in accordance with claim 8, wherein the drive means comprises an electric motor mounted to the backplate.

10. The cross-arm regulator assembly for a motor vehicle window panel in accordance with claim 9, wherein the load absorber means further comprises an elastomeric bumper between the backplate and one of the sector gear and the lifting arm to absorb drive force at least at the open or closed position of the window panel.

* * * * *